US009081352B2

(12) United States Patent
Okazaki

(10) Patent No.: US 9,081,352 B2
(45) Date of Patent: Jul. 14, 2015

(54) IMAGE FORMING APPARATUS

(71) Applicant: Brother Kogyo Kabushiki Kaisha, Nagoya-shi, Aichi-ken (JP)

(72) Inventor: Yoshiyuki Okazaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/301,369

(22) Filed: Jun. 11, 2014

(65) Prior Publication Data

US 2014/0363195 A1 Dec. 11, 2014

(30) Foreign Application Priority Data

Jun. 11, 2013 (JP) ..... 2013-122901

(51) Int. Cl.
*G03G 15/16* (2006.01)
*G03G 21/00* (2006.01)

(52) U.S. Cl.
CPC ..... *G03G 21/0011* (2013.01)

(58) Field of Classification Search
CPC ..... G03G 15/161; G03G 15/168; G03G 15/0189; G03G 2215/1661; G03G 2215/0132
USPC ..... 399/101
See application file for complete search history.

(56) References Cited

U.S. PATENT DOCUMENTS

2007/0230992 A1* 10/2007 Takayanagi ..... 399/101
2011/0229234 A1* 9/2011 Hozumi et al. ..... 399/357
2012/0051779 A1* 3/2012 Fukuhara ..... 399/101
2013/0287421 A1* 10/2013 Makino ..... 399/66

FOREIGN PATENT DOCUMENTS

JP 2007-225919 A 9/2007
JP 2011-232698 A 11/2011

* cited by examiner

*Primary Examiner* — Walter L Lindsay, Jr.
*Assistant Examiner* — Frederick Wenderoth
(74) *Attorney, Agent, or Firm* — Banner & Witcoff, Ltd.

(57) ABSTRACT

An image forming apparatus including a belt cleaner including a scraping blade and roller pairs each including an elastic roller and a metal roller, the roller pairs including a first roller pair including a first elastic roller as a cleaning roller contacting a belt while rotating in a rotational tangential direction opposite to a belt traveling direction at a contact portion with the belt, and one or more second roller pairs each including a second elastic roller contacting an adjacent metal roller of a roller pair adjacent to the second roller pair while rotating at a circumferential velocity lower than that of the adjacent metal roller in a rotational tangential direction opposite to that of the adjacent metal roller at a contact portion with the adjacent metal roller, the scraping blade contacting an outer circumferential surface of a specific metal roller of the one or more second roller pairs.

7 Claims, 2 Drawing Sheets

IMAGE FORMING APPARATUS

CROSS-REFERENCE TO RELATED APPLICATION

This application claims priority under 35 U.S.C. §119 from Japanese Patent Application No. 2013-122901 filed on Jun. 11, 2013. The entire subject matter of the application is incorporated herein by reference.

BACKGROUND

1. Technical Field

The following description relates to one or more techniques for an electrophotographic type image forming apparatus having an endless belt.

2. Related Art

An image forming apparatus has been known that includes a belt and is configured to form an image on a sheet in an electrophotographic method. The known image forming apparatus may, for instance, be a direct-printing type image forming apparatus configured to directly transfer a developer image onto a sheet being conveyed on a belt. Alternatively, the known image forming apparatus may be an intermediate-transfer type image forming apparatus configured to transfer a developer image onto a belt, and then transfer onto a sheet the developer image transferred on the belt.

In the electrophotographic type image forming apparatus including the belt, regardless of whether the apparatus is of the direct-printing type or the intermediate-transfer type, it is required to remove from the belt adhesive material such as development agent adhering onto the belt. For instance, a belt cleaner configured to remove adhesive material from the belt may include a cleaning roller, a cleaning shaft, and a scraping blade.

The cleaning roller may be configured to remove adhesive material from the belt while rotating in a rotational tangential direction opposite to a traveling direction of the belt at a contact portion between the cleaning roller and the belt. The cleaning shaft may be configured to remove adhesive material from the cleaning roller while rotating in a rotational tangential direction identical to a rotational tangential direction of the cleaning roller at a contact portion between the cleaning shaft and the cleaning roller. The scraping blade may be configured to scrape off adhesive material from the cleaning shaft while sliding relative to and in contact with an outer circumferential surface of the cleaning shaft.

SUMMARY

In the known image forming apparatus, when a traveling velocity of the belt is raised so as to increase an image forming speed (a printing speed), it is required to raise rotational speeds of the cleaning roller and the cleaning shaft accordingly.

However, a rise in a circumferential velocity of the cleaning shaft in response to the rotational speed of the cleaning shaft being raised might cause a greater vibration (e.g., a greater stick-slip vibration) of the scraping blade. Consequently, it might be impossible to sufficiently scrape off the adhesive material from the cleaning shaft.

Aspects of the present invention are advantageous to provide one or more improved techniques, for an image forming apparatus, which make it possible to suppress a rise in a vibration of a scraping blade even though a traveling velocity of a belt is raised.

According to aspects of the present invention, an image forming apparatus is provided, which includes an endless belt wound around at least two rollers, an electrophotographic image forming unit disposed to face the endless belt, and a belt cleaner configured to remove adhesive material adhering onto the endless belt, the belt cleaner including a scraping blade, and a plurality of roller pairs each including an elastic roller having an outer circumferential surface made of elastic material, and a metal roller having an outer circumferential surface made of metal, the metal roller disposed to contact the outer circumferential surface of the elastic roller, the metal roller configured to remove adhesive material adhering onto the outer circumferential surface of the elastic roller while rotating in a rotational tangential direction identical to a rotational tangential direction of the elastic roller at a contact portion between the metal roller and the elastic roller. The plurality of roller pairs include a first roller pair including a first elastic roller that is a cleaning roller disposed to contact the endless belt and configured to remove the adhesive material adhering onto the endless belt while rotating in a rotational tangential direction opposite to a traveling direction of the endless belt at a contact portion between the cleaning roller and the endless belt, and one or more second roller pairs different from the first roller pair, each second roller pair including a second elastic roller disposed to contact an adjacent metal roller included in a roller pair adjacent to the second roller pair, the second elastic roller configured to remove adhesive material adhering onto an outer circumferential surface of the adjacent metal roller while rotating at a circumferential velocity lower than a circumferential velocity of the adjacent metal roller in a rotational tangential direction opposite to a rotational tangential direction of the adjacent metal roller at a contact portion between the second elastic roller and the adjacent metal roller. The scraping blade is disposed to contact an outer circumferential surface of a specific metal roller included in a specific roller pair of the one or more second roller pairs different from the first roller pair, and configured to scrape adhesive material adhering onto the outer circumferential surface of the specific metal roller.

BRIEF DESCRIPTION OF THE ACCOMPANYING DRAWINGS

DETAILED DESCRIPTION

Figure 1:
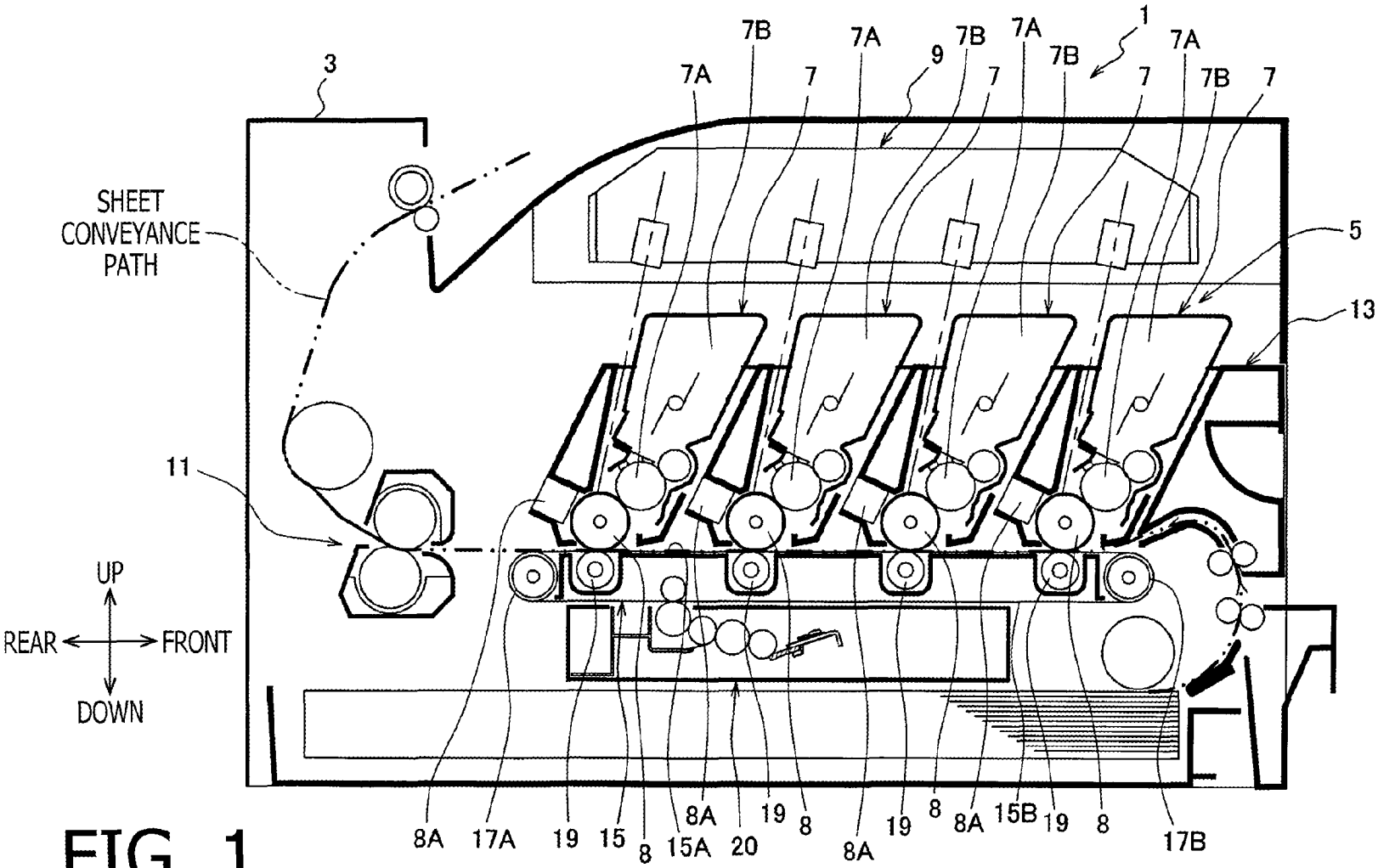
FIG. 1 is a cross-sectional side view of an image forming apparatus in a first embodiment according to one or more aspects of the present invention.

It is noted that various connections are set forth between elements in the following description. It is noted that these connections in general and, unless specified otherwise, may be direct or indirect and that this specification is not intended to be limiting in this respect.

Hereinafter, embodiments, in which aspects of the present invention are applied to an electrophotographic type image forming apparatus, will be described with reference to the accompanying drawings. It is noted that, in the drawings, arrows for indicating directions are shown for the sake of easy understanding of correlations between the drawings and between elements. However, the arrows are not intended to be limiting a scope of the present invention. Further, it is noted that, regarding at least each element set forth with a reference character, it may be at least one element, unless specified otherwise using expressions such as "a plurality of" and "two or more."

First Embodiment

1. General Configuration of Image Forming Apparatus

As shown in FIG. 1, an image forming apparatus 1 contains, in a housing 3 thereof, an image forming unit 5 configured to form an image on a sheet. The image forming unit 5 is of an electrophotographic type including a plurality of development cartridges 7, a plurality of photoconductive drums 8, an exposure unit 9, and a fuser unit 11.

Each development cartridge 7 includes a development roller 7A and a container 7B. The plurality of photoconductive drums 8 are disposed in positions corresponding to the plurality of development cartridges 7, respectively. Each photoconductive drum 8 is configured to carry a developer image thereon. Each of a plurality of chargers 8A is configured to charge a corresponding photoconductive drum 8 disposed to face the charger 8A.

The exposure unit 9 is configured to expose the plurality of charged photoconductive drums 8 so as to form an electrostatic latent image on each photoconductive drum 8. Each development roller 7A is configured to supply a corresponding photoconductive drum 8 with development agent stored in a corresponding container 7B so as to form a developer image corresponding to the electrostatic latent image.

The plurality of development cartridges 7 are detachably attached to a single drawer 13. The drawer 13 is movable relative to an apparatus main body. When the drawer 13 is pulled forward relative to the apparatus main body, the plurality of development cartridges 7 are brought into a state detachable from the drawer 13.

It is noted that the apparatus main body is an unreplaceable part, including a main frame (not shown) and the housing 3, which is not allowed to be detached from the apparatus by a user. A belt 15 is an endless belt wound around a driving roller 17A and a driven roller 17B. A portion of the belt 15 that faces the image forming unit 5 (hereinafter, the portion may be referred to as a transfer surface 15A) moves from the driven roller 17B toward the driving roller 17A in a state stretched between the driving roller 17A and the driven roller 17B.

There are transfer portions 19 each disposed in a position to face a corresponding photoconductive drum 8 across the transfer surface 15A. Each transfer portion 19 is configured to transfer the developer image carried on a corresponding photoconductive drum 8 onto the transfer surface 15A or a sheet placed on the transfer surface 15A.

Accordingly, the developer images carried on the photoconductive drums 8 are transferred onto the transfer surface 15A or the sheet placed on the transfer surface 15A in a superimposed manner. It is noted that the image forming unit 5 of the first embodiment is of a direct printing type. Therefore, the developer images are directly transferred onto the sheet placed on the transfer surface 15A in a superimposed manner. The fuser unit 11 is configured to directly or indirectly heat the development agent transferred on the sheet so as to thermally fix the development agent onto the sheet.

On a side opposite to the image forming unit 5 across the belt 15, a belt cleaner 20 is disposed. The belt cleaner 20 is configured to remove from the belt 15 adhesive material (such as development agent) adhering onto the belt 15. It is noted that the belt cleaner 20 of the first embodiment is detachably attached to the apparatus main body in a state where the belt cleaner 20 is disposed below the belt 15, more specifically, on a side under a lower stretched surface 15B (hereinafter, which may be referred to as a cleaner-facing surface 15B) of the belt 15.

2. Belt Cleaner

2.1 Structure of Belt Cleaner

In the image forming apparatus 1 of the first embodiment, patches for adjusting color densities and/or registration marks for detecting color shifts are transferred onto the belt 15 at such appropriate moments when image formation on a sheet is not performed. Thereafter, the belt cleaner 20 retrieves development agent transferred as the patches and/or the registration marks, as adhesive material adhering onto the belt 15.

Figure 2:
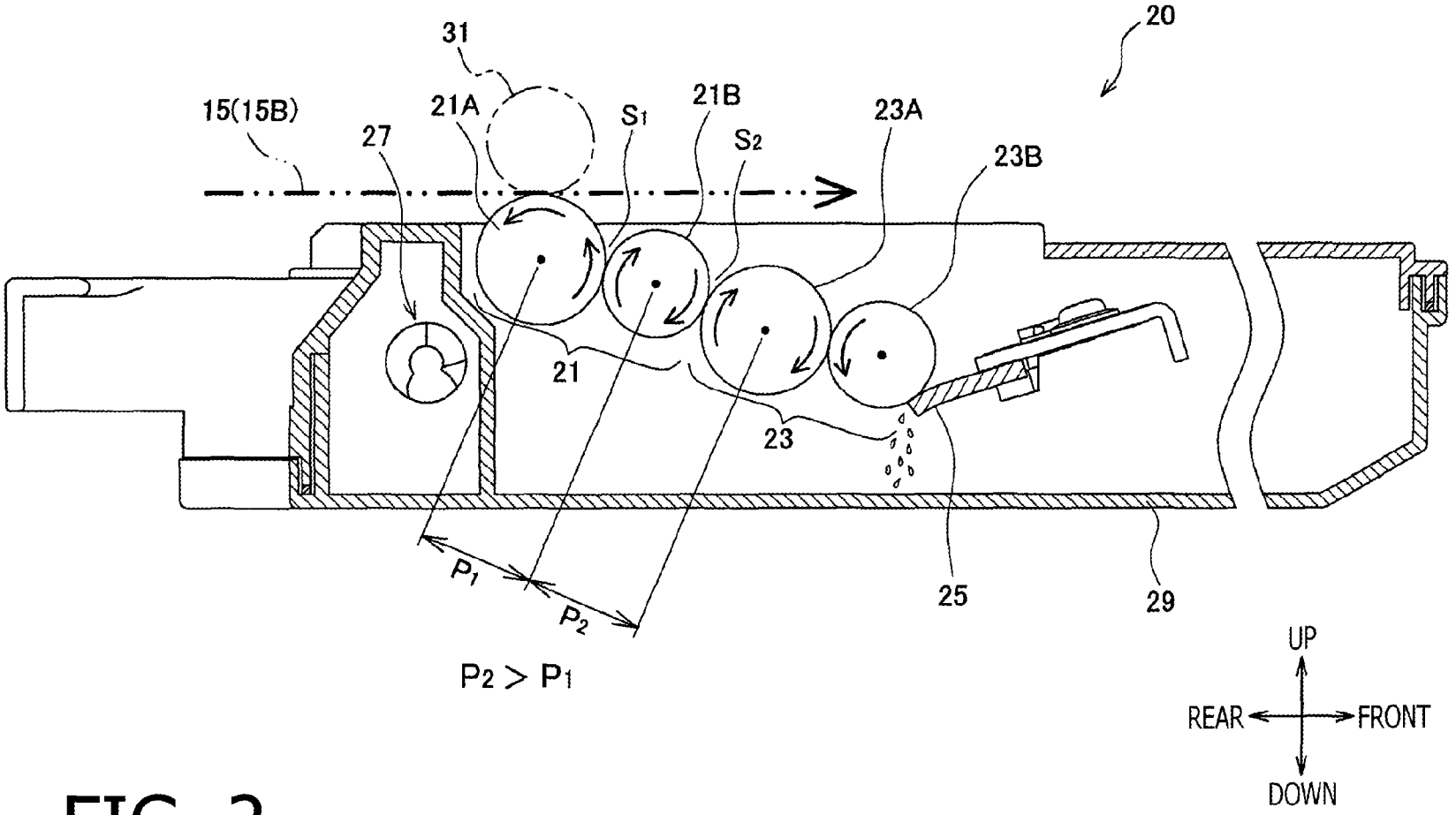
FIG. 2 is a cross-sectional side view of a belt cleaner of the image forming apparatus in the first embodiment according to one or more aspects of the present invention.

As shown in FIG. 2, the belt cleaner 20 includes at least two roller pairs 21 and 23, a scraping blade 25, an auger 27, and a storage portion 29. Hereinafter, the at least two roller pairs 21 and 23 may be referred to as a first roller pair 21 and a second roller pair 23, respectively, in an order closer to the belt 15.

The first roller pair 21 includes an elastic roller 21A and a metal roller 21B. Likewise, the second roller pair 23 includes an elastic roller 23A and a metal roller 23B. Namely, each roller pair 21 and 23 includes a single pair of the elastic roller and the metal roller.

Hereinafter, the elastic roller 21A of the first roller pair 21 may be referred to as a first elastic roller 21A. The elastic roller 23A of the second roller pair 23 may be referred to as a second elastic roller 23A. Likewise, the metal roller 21B of the first roller pair 21 may be referred to as a first metal roller 21B. The metal roller 23B of the second roller pair 23 may be referred to as a second metal roller 23B.

The first elastic roller 21A, of the first roller pair 21 that is a roller pair closest to the belt 15 of the at least two roller pairs 21 and 23, is configured to contact the cleaner-facing surface 15B of the belt 15.

Further, the first elastic roller 21A is configured to retrieve adhesive material adhering onto the belt 15 while rotating in a rotational tangential direction, opposite to a traveling direction of the belt 15, at a contact portion in contact with the cleaner-facing surface 15B. Hereinafter, the first elastic roller 21A may be referred to as a cleaning roller 21A.

It is noted that the rotational tangential direction of the cleaning roller 21A at the contact portion between the cleaning roller 21A and the cleaner-facing surface 15B is a direction, which is identical to a rotational direction of the cleaning roller 21A, of tangential directions of the cleaning roller 21A at the contact portion between the cleaning roller 21A and the cleaner-facing surface 15B.

In the first embodiment, the rotational tangential direction of the cleaning roller 21A is oriented toward a rear side from a front side of the image forming apparatus 1. Further, a circumferential velocity of the cleaning roller 21A is lower than a traveling velocity of the belt 15.

To the cleaning roller 21A, applied is an electric potential (in the first embodiment, a negative potential) having a polarity opposite to a polarity of the charged development agent adhering onto the belt 15. Therefore, the adhesive material adhering onto the belt 15 is removed (retrieved) from the belt 15, (a) by being mechanically scraped from the belt 15 as the cleaning roller 21A rotates in the direction opposite to the traveling direction of the belt 15, and (b) by being attracted by an electrostatic attractive force generated between the cleaning roller 21A and the adhesive material.

On an opposite side of the cleaning roller 21A with respect to the cleaner-facing surface 15B, a backup roller 31 is disposed. The backup roller 31 is configured to press the cleaner-facing surface 15B against the cleaning roller 21A. Therefore, the cleaning roller 21A is allowed to certainly remove (retrieve) the adhesive material from the belt 15.

An outer circumferential surface of the cleaning roller 21A that is configured to contact the belt 15 is made of elastic foamed material such as sponge. Therefore, the adhesive material removed (retrieved) from the belt 15 is held by micropores formed in the outer circumferential surface of the cleaning roller 21A.

Further, an outer circumferential surface of the second elastic roller 23A is made of elastic material (e.g., elastic foamed material). It is noted that, in the first embodiment, the outer circumferential surface of the first elastic roller 21A (i.e., the cleaning roller 21A) and the outer circumferential surface of the second elastic roller 23A are made of the same kind of elastic material. Nonetheless, in the belt cleaner 20 according to aspects of the present invention, it is only necessary that at least the outer circumferential surface of the first elastic roller 21A is made of elastic material (e.g., elastic foamed material).

The first metal roller 21B is configured to rotate in contact with at least the first elastic roller 21A of the first roller pair 21 (in which the first metal roller 21B is included), and to remove (retrieve) adhesive material adhering onto the outer circumferential surface of the first elastic roller 21A. Further, an outer circumferential surface of the first metal roller 21B is made of metal.

Further, the first metal roller 21B is configured to rotate in a rotational tangential direction identical to a rotational tangential direction of the first elastic roller 21A, at a contact portion between the first metal roller 21B and the first elastic roller 21A.

It is noted that the rotational tangential direction of the first metal roller 21B at the contact portion between the first metal roller 21B and the first elastic roller 21A is a direction, which is identical to a rotational direction of the first metal roller 21B, of tangential directions of the first metal roller 21B at the contact portion between the first metal roller 21B and the first elastic roller 21A.

It is noted that the rotational tangential direction of the first elastic roller 21A at the contact portion between the first metal roller 21B and the first elastic roller 21A is a direction, which is identical to the rotational direction of the first elastic roller 21A, of tangential directions of the first elastic roller 21A at the contact portion between the first metal roller 21B and the first elastic roller 21A.

In the first embodiment, the rotational tangential direction of the first metal roller 21B and the rotational tangential direction of the first elastic roller 21A at the contact portion are such a direction as to become closer to the cleaner-facing surface 15B. Specifically, those rotational tangential directions are oriented upward from beneath.

The elastic roller 23A of the plurality of elastic rollers 21A and 23A other than the cleaning roller 21A is configured to contact the metal roller 21B of the roller pair 21 adjacent to the roller pair 23 in which the elastic roller 23A is included. Specifically, the second elastic roller 23A of the second roller pair 23 is configured to contact the first metal roller 21B of the first roller pair 21.

The second elastic roller 23A is configured to rotate in a rotational tangential direction opposite to a rotational tangential direction of the first metal roller 21B, at a contact portion between the second elastic roller 23A and the first metal roller 21B. Further, the second elastic roller 23A is configured to remove (retrieve) adhesive material adhering onto the outer circumferential surface of the first metal roller 21B while rotating at a circumferential velocity lower than a circumferential velocity of the first metal roller 21B.

It is noted that the rotational tangential direction of the first metal roller 21B at the contact portion between the first metal roller 21B and the second elastic roller 23A is a direction, which is identical to the rotational direction of the first metal roller 21B, of tangential directions of the first metal roller 21B at the contact portion between the first metal roller 21B and the second elastic roller 23A.

It is noted that the rotational tangential direction of the second elastic roller 23A at the contact portion between the first metal roller 21B and the second elastic roller 23A is a direction, which is identical to a rotational direction of the second elastic roller 23A, of tangential directions of the second elastic roller 23A at the contact portion between the first metal roller 21B and the second elastic roller 23A.

In the first embodiment, the rotational tangential direction of the first metal roller 21B at the contact portion between the first metal roller 21B and the second elastic roller 23A is such a direction as to become farther away from the cleaner-facing surface 15B, i.e., a direction facing downward from above. Further, the rotational tangential direction of the second elastic roller 23A at the contact portion between the first metal roller 21B and the second elastic roller 23A is a direction facing upward from beneath.

In the same manner as the first elastic roller 21A, to the first metal roller 21B, the second elastic roller 23A, and the second metal roller 23B, applied is an electric potential having a polarity opposite to a polarity of charged adhesive material adhering onto the rollers 21B, 23A, and 23B. Therefore, the adhesive material adhering onto the rollers 21B, 23A, and 23B is removed (retrieved) by an electrostatic attractive force.

In particular, the second elastic roller 23A has the rotational tangential direction opposite to the rotational tangential direction of the first metal roller 21B at the contact portion between the first metal roller 21B and the second elastic roller 23A. Hence, the adhesive material adhering onto the first metal roller 21B is removed (retrieved) by being mechanically scraped as well as the electrostatic attractive force.

The scraping blade 25 is configured to slide relative to and in contact with the outer circumferential surface of the second metal roller 23B of the second roller pair 23, farthest from the cleaner-facing surface 15B, of the plurality of roller pairs 21 and 23. Thereby, the scraping blade 25 is allowed to mechanically scrape the adhesive material adhering onto the outer circumferential surface of the second metal roller 23B.

The adhesive material scraped off by the scraping blade 25 is stored into the storage portion 29. The adhesive material stored in the storage portion 29 is transported to a position spaced apart from the scraping blade 25 by a transporting member (not shown) such as an agitator. Thereby, the retrieved material is accumulating evenly in the storage portion 29.

The scraping blade 25 is disposed downstream in the traveling direction of the cleaner-facing surface 15B of the belt 15 relative to a contact position where the cleaning roller 21A contacts the cleaner-facing surface 15B. The plurality of elastic rollers 21A and 23A and the plurality of metal rollers 21B and 23B are arranged along a direction oriented from the contact position toward a downstream side in the traveling direction of the belt 15.

An arrangement direction in which the plurality of rollers 21A, 21B, 23A, and 23B are arranged intersects the cleaner-facing surface 15B of the belt 15. The scraping blade 25 is disposed to contact the second metal roller 23B that is located at an end in the arrangement direction of the plurality of 21A, 21B, 23A, and 23B. It is noted that a beginning in the arrangement direction represents a side closest to the cleaner-facing surface 15B, and the end in the arrangement direction represents a side farthest from the cleaner-facing surface 15B.

The first elastic roller 21A, the first metal roller 21B, the second elastic roller 23A, and the second metal roller 23B are configured to rotate in a mechanically synchronized manner, via power transmission members (not shown) such as gears and toothed belt. Circumferential velocities of the rollers 21A, 21B, 23A, and 23B are set in accordance with gear ratios of the power transmission members.

In the first embodiment, a ratio of the circumferential velocity of the first elastic roller 21A to the traveling velocity of the cleaner-facing surface 15B is about 0.6. A ratio of the circumferential velocity of the first metal roller 21B to the traveling velocity of the cleaner-facing surface 15B is about 0.6. A ratio of the circumferential velocity of the second elastic roller 23A to the traveling velocity of the cleaner-facing surface 15B is about 0.36. A ratio of the circumferential velocity of the second metal roller 23B to the traveling velocity of the cleaner-facing surface 15B is about 0.36.

The auger 27 is configured to transport the adhesive material stored in the storage portion 29 to a detector (not shown). The detector is configured to detect whether the amount of the adhesive material accumulating in the storage portion 29 (i.e., the belt cleaner 20) is more than a predetermined amount. It is noted that the "predetermined amount" is a design value appropriately set based on a capacity of the storage portion 29.

2.2 Contact Surface Pressures of Rollers

At the contact portion (hereinafter referred to as a first contact portion S1) between the first elastic roller 21A and the first metal roller 21B, the rotational tangential directions of the two rollers 21A and 21B are coincident with each other. At the contact portion (hereinafter referred to as a second contact portion S2) between the first metal roller 21B and the second elastic roller 23A, the rotational tangential directions of the two rollers 21B and 23A are opposite to each other.

Therefore, a rotational resistance at the second contact portion S2 might be greater than a rotational resistance at the first contact portion S1. When the rotational resistance at the second contact portion S2 is greater than the rotational resistance at the first contact portion S1, there might be caused troubles and/or failures in the rotations of the rollers 21A, 21B, 23A, and 23B. In the first embodiment, in view of the problem, a contact surface pressure at the second contact portion S2 is set lower than a contact surface pressure at the first contact portion S1.

In other words, in the first embodiment, a contact surface pressure between a specific metal roller 21B and a downstream elastic roller 23A is lower than a contact surface pressure between the specific metal roller 21B and an upstream elastic roller 21A. It is noted that (a) the specific metal roller 21B represents the first metal roller 21B, which is one of the plurality of metal rollers 21B and 23B that contacts two elastic rollers 21A and 23A. Additionally, (b) the upstream elastic roller 21A represents the first elastic roller 21A, which is of the first roller pair 21 including the specific metal roller 21B. Further, (c) the downstream elastic roller 23A represents the second elastic roller 23A, which is of the second roller pair 23 adjacent to the first roller pair 21 including the specific metal roller 21B.

Therefore, in the first embodiment, a distance P2 between central axes of the specific metal roller 21B and the downstream elastic roller 23A is longer than a distance P1 between central axes of the specific metal roller 21B and the upstream elastic roller 21A. It is noted that, in the first embodiment, a diameter of the upstream elastic roller 21A is identical to a diameter of the downstream elastic roller 23A.

3. Features of Image Forming Apparatus (Particularly, of Belt Cleaner)

The belt cleaner 20 of the first embodiment includes the first roller pair 21 including the first elastic roller 21A and the first metal roller 21B, and the second roller pair 23 including the second elastic roller 23A and the second metal roller 23B. The circumferential velocity of the second elastic roller 23A is lower than the circumferential velocity of the first metal roller 21B.

Thereby, even when the traveling velocity of the belt 15 is raised, it is possible to avoid a rise in the circumferential velocity of the second metal roller 23B in contact with the scraping blade 25. Accordingly, it is possible to prevent occurrence of a great stick-slip vibration of the scraping blade 25. Thus, it is possible to avoid a drop in efficiency for removing (retrieving) the adhesive material.

In the first embodiment, the belt cleaner 20 includes even numbers of roller pairs 21 and 23. Further, the scraping blade 25 is disposed downstream in the traveling direction of the belt 15 (more specifically, the cleaner-facing surface 15B) relative to the position where the cleaning roller 21A contacts (the cleaner-facing surface 15B of) the belt 15.

Thereby, in the first embodiment, it is possible to prevent an increase in a vertical dimension of the belt cleaner 20 including the plurality of roller pairs 21 and 23 and the scraping blade 25, and to easily let the adhesive material scraped off by the scraping blade 25 fall downward.

If the scraping blade 25 were located upstream in the traveling direction of (the cleaner-facing surface 15B of) the belt 15, the scraping blade 25 would need to be disposed above the second metal roller 23B. Therefore, since the scraped material might accumulate on the second metal roller 23B, it might be difficult to let the adhesive material fall downward.

In the first embodiment, the contact surface pressure at the second contact portion S2 is lower than the contact surface pressure at the first contact portion S1. Thereby, in the first embodiment, it is possible to prevent generation of a great rotational resistance at the second contact portion S2 where the first metal roller 21B and the second elastic roller 23A contact each other while rotating in the mutually-opposite rotational tangential directions.

Second Embodiment

In the first embodiment, the diameter of the first metal roller 21B is equal to the diameter of the second metal roller 23B. In a second embodiment, a diameter of the second metal roller 23B, which contacts the scraping blade 25, is larger than a diameter of the first metal roller 21B that does not contact the scraping blade 25.

In the meantime, as a surface with which the scraping blade 25 is in contact becomes flatter (i.e., as a curvature of the surface that contacts the scraping blade 25 becomes smaller), the scraping blade 25 is able to more efficiently scrape the adhesive material. In the second embodiment, the second metal roller 23B with which the scraping blade 25 is in contact has a diameter larger than the diameter of the first metal roller 21B. Therefore, it is possible to achieve a small curvature of the outer circumferential surface of the second metal roller 23B that contacts the scraping blade 25. Thus, it is possible to more efficiently scrape the adhesive material.

Further, as the diameter of the second metal roller 23B that contacts the scraping blade 25 becomes larger, a time period for which the scraping blade 25 slides relative to and in contact with an identical portion of the second metal roller 23B becomes shorter. Accordingly, it is possible to prevent the second metal roller 23B from being damaged easily or quickly, and to improve durability of the second metal roller 23B.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible. It is noted that, in the following modifications, explanations of the same configurations as exemplified in the aforementioned embodiments will be omitted.

Modifications

In the aforementioned embodiments, the first elastic roller 21A, the first metal roller 21B, the second elastic roller 23A, and the second metal roller 23B are configured to rotate in a mechanically synchronized manner, via power transmission members (not shown) such as gears and toothed belt. Nonetheless, the present invention is not limited to such a configuration.

In the aforementioned first embodiment, the ratio of the circumferential velocity of the first elastic roller 21A to the traveling velocity of the cleaner-facing surface 15B is about 0.6. The ratio of the circumferential velocity of the first metal roller 21B to the traveling velocity of the cleaner-facing surface 15B is about 0.6. The ratio of the circumferential velocity of the second elastic roller 23A to the traveling velocity of the cleaner-facing surface 15B is about 0.36. The ratio of the circumferential velocity of the second metal roller 23B to the traveling velocity of the cleaner-facing surface 15B is about 0.36. Nonetheless, the present invention is not limited to such a configuration.

In the aforementioned embodiments, exemplified is the configuration that the two roller pairs 21 and 23 are provided. However, according to aspects of the present invention, three or more roller pairs may be provided.

In the aforementioned embodiments, the scraping blade 25 is disposed downstream in the traveling direction of the cleaner-facing surface 15B of the belt 15 relative to the contact position where the cleaning roller 21A contacts the cleaner-facing surface 15B. However, for instance, the scraping blade 25 may be disposed upstream in the traveling direction of the cleaner-facing surface 15B of the belt 15 relative to the contact position where the cleaning roller 21A contacts the cleaner-facing surface 15B.

In the aforementioned embodiments, the arrangement direction of the rollers 21A, 21B, 23A, and 23B is a direction oriented toward a downstream side in the traveling direction of the cleaner-facing surface 15B from the contact position where the cleaning roller 21A contacts the cleaner-facing surface 15B. Further, the arrangement direction of the rollers 21A, 21B, 23A, and 23B intersects the cleaner-facing surface 15B of the belt 15. Nonetheless, the present invention is not limited to such a configuration.

In the aforementioned first embodiment, the contact surface pressure at the second contact portion S2 is set lower than the contact surface pressure at the first contact portion S1. However, the contact surface pressure at the second contact portion S2 may be set the same as the contact surface pressure at the first contact portion S1.

What is claimed is:

1. An image forming apparatus comprising:

an endless belt wound around at least two rollers;

an electrophotographic image forming unit disposed to face the endless belt; and a belt cleaner configured to remove adhesive material adhering onto the endless belt, the belt cleaner comprising:

a scraping blade; and a plurality of roller pairs each comprising:

an elastic roller having an outer circumferential surface made of elastic material; and a metal roller having an outer circumferential surface made of metal, the metal roller disposed to contact the outer circumferential surface of the elastic roller, the metal roller configured to remove adhesive material adhering onto the outer circumferential surface of the elastic roller while rotating in a rotational tangential direction identical to a rotational tangential direction of the elastic roller at a contact portion between the metal roller and the elastic roller, wherein the plurality of roller pairs comprise:

a first roller pair comprising a first elastic roller that is a cleaning roller disposed to contact the endless belt and configured to remove the adhesive material adhering onto the endless belt while rotating in a rotational tangential direction opposite to a traveling direction of the endless belt at a contact portion between the cleaning roller and the endless belt; and one or more second roller pairs different from the first roller pair, each second roller pair comprising a second elastic roller disposed to contact an adjacent metal roller included in a roller pair adjacent to the second roller pair, the second elastic roller configured to remove adhesive material adhering onto an outer circumferential surface of the adjacent metal roller while rotating at a circumferential velocity lower than a circumferential velocity of the adjacent metal roller in a rotational tangential direction opposite to a rotational tangential direction of the adjacent metal roller at a contact portion between the second elastic roller and the adjacent metal roller, and wherein the scraping blade is disposed to contact an outer circumferential surface of a specific metal roller included in a specific roller pair of the one or more second roller pairs different from the first roller pair, and configured to scrape adhesive material adhering onto the outer circumferential surface of the specific metal roller.

2. The image forming apparatus according to claim 1, wherein the plurality of roller pairs of the belt cleaner are an even number of roller pairs, and wherein the scraping blade is disposed downstream in a traveling direction of the endless belt relative to the contact portion between the cleaning roller and the endless belt.

3. The image forming apparatus according to claim 1, wherein the elastic rollers and the metal rollers of the plurality of roller pairs are arranged along a predetermined direction oriented from the contact portion between the cleaning roller and the endless belt toward a downstream side in the traveling direction of the endless belt, the predetermined direction intersecting a cleaner-facing surface of the endless belt that faces the belt cleaner.

4. The image forming apparatus according to claim 1, wherein the metal rollers of the plurality of roller pairs comprise a double-contact metal roller configured to contact two elastic rollers comprising:

a first-adjacent elastic roller included in a roller pair including the double-contact metal roller; and a second-adjacent elastic roller included in a roller pair adjacent to the roller pair including the double-contact metal roller, and wherein a contact surface pressure between the double-contact metal roller and the second-adjacent elastic roller is lower than a contact surface pressure between the double-contact metal roller and the first-adjacent elastic roller.

5. The image forming apparatus according to claim 4, wherein the first-adjacent elastic roller has a diameter identical to a diameter of the second-adjacent elastic roller, and wherein a distance between central axes of the double-contact metal roller and the second-adjacent elastic roller is longer than a distance between central axes of the double-contact metal roller and the first-adjacent elastic roller.

6. The image forming apparatus according to claim 1, wherein the specific metal roller disposed to contact the scraping blade has a diameter larger than a diameter of any other metal roller included in the plurality of roller pairs.

7. The image forming apparatus according to claim 1, wherein the plurality of roller pairs are two roller pairs.

* * * * *